United States Patent [19]

Augustine, Jr. et al.

[11] 3,989,245

[45] Nov. 2, 1976

[54] TENNIS PRACTICE DEVICE HAVING PNEUMATIC BALL PROJECTOR

[76] Inventors: Paul Augustine, Jr.; Jesse Brian Fender, Jr.; Donald Laverel Hildreth, all of 900 N. Broadway, Suite 725, Santa Ana, Calif. 92701

[22] Filed: Mar. 1, 1974

[21] Appl. No.: 447,306

[52] U.S. Cl. ..... 273/29 A; 124/56; 124/51 A; 302/2 R; 272/3; 124/81

[51] Int. Cl.[2] ..... A63B 69/00

[58] Field of Search ..... 273/29 R, 29 A, 26 R, 273/26 A, 26 D, 129, 35 B, 181 C, 181 U, 11 R, 51 R; 272/3; 124/11 R, 41, 51 R, 51 A; 302/2 R, 24

[56] References Cited

UNITED STATES PATENTS

| | | | |
|---|---|---|---|
| 2,087,575 | 7/1937 | Littell et al. | 273/29 A |
| 2,182,369 | 12/1939 | Barron | 124/30 R |
| 2,626,312 | 1/1953 | Clark et al. | 273/181 C |
| 2,823,034 | 2/1958 | Bingham, Jr. | 273/29 R |
| 2,944,816 | 7/1960 | Dixon | 273/26 A |
| 3,467,073 | 9/1969 | Rhodes | 124/11 R |
| 3,563,544 | 2/1971 | Hedrick | 273/29 A |
| 3,567,223 | 3/1971 | Gentiluomo | 273/35 B |
| 3,640,263 | 2/1972 | Rhodes | 124/30 R |

FOREIGN PATENTS OR APPLICATIONS

| | | | |
|---|---|---|---|
| 239,280 | 10/1911 | Germany | 273/29 R |
| 395,830 | 1/1966 | Switzerland | 273/29 R |
| 347,389 | 4/1931 | United Kingdom | 273/29 A |

*Primary Examiner*—Richard C. Pinkham
*Assistant Examiner*—T. Brown

[57] ABSTRACT

An instant tennis game simulating a real game of tennis is presented. A pneumatic tennis ball delivery machine replaces the normal opponent. The court is slightly crowned and has sloping gutters so that all balls are automatically, gravity-returned to the machine. Solenoid controlled, motor-spun rollers permit simulation of various types of spins. Ball trajectory from the machine is controlled by barrel angle, vertical and horizontal. The ball machine control system allows for repetition of one "shot condition" endlessly or a completely random variety of shots as directed by a programmed mini-computer or manually set "user controls," a program, or the equivalent.

5 Claims, 11 Drawing Figures

-------- CONTROL SIGNAL
—··—··— ELECTRICAL POWER

TENNIS PRACTICE DEVICE HAVING PNEUMATIC BALL PROJECTOR

BACKGROUND OF THE INVENTION

1. Field of the Invention

The present invention relates to simulations of tennis games which can be played immediately, without the necessity of finding an opponent, as a practice device to develop the physical skills of the player.

2. Description of the Prior Art

Automatic ball hurling machines have been used in various sports for more than a generation. Baseball throwing machines have been designed which simulate various types of spin, thereby simulating curve balls and other pitches. Tennis balls hurling machines must be reloaded by hand, so that for efficient operation, vast quantities of tennis balls are required. Since tennis balls lose their liveliness a short time after removal from the can, it has been economically unfeasible to provide automatic tennis ball machines for the general public. In addition, the requirement for reloading means that the average machine is only being used about 50% of the time, with the other 50% of the time being used to reload.

While prior art baseball machines have been devised simulating baseball pitches, no prior art tennis machine has been capable of simulating the vast variety of possible tennis shots. Baseball machines have generally been purchased by teams having considerable financial backing. Since tennis is a public sport participated in by people who are making considerably less than the average baseball salary, a tennis ball machine must be relatively inexpensive to manufacture.

Land prices in urban areas seem to continually increase to previously unthought of levels. A player practicing against a machine does not need a full court. All that is needed is a simulation of conditions which exist when he plays against an opponent on a full court.

Because of the nature of the cover of the tennis ball and the fact that a tennis ball is struck by a racket having strings therein, and because frequently a tennis ball will hit the ground before it is returned, a wide variety of spins must be simulated in order to simulate tennis. The necessary number of spins vastly exceeds the number required to be put on a baseball by an automatic baseball throwing machine, because the tennis racket can do everything with a tennis ball that a baseball pitcher can do, and can do considerably more besides.

SUMMARY OF THE INVENTION

An instant tennis game is presented which simulates in a smaller area and without an opponent many of the conditions occurring in a normal tennis game. The tennis court on the player's side of the net is the length of a normal tennis court, but is narrower. On the opposite side of the net, the court is not only narrower, but is much shorter, since the tennis ball machine is placed near the point where the service line would be in a normal tennis court.

The tennis court is crowned on both sides so that balls roll off to the side and into a gutter. The gutter slopes down toward the machine so that all tennis balls hit roll to the gutter, then roll back to the machine via the gutter on either side of the court. A gutter slope of about 3-¾ percent is sufficient to cause tennis balls to return to the machine. A simulated, opposite court with acoustically responsive background may be a part of the inclined backstop which allows a scoring mechanism to record and display the player's accuracy.

The machine is set by the player for various speeds, directions, and spins. Direction and trajectory are imparted to the ball by aiming the barrel of the machine in the desired direction and elevation. Spin is imparted by solenoid controlled motor-spun rollers, one roller along the top of the barrel and one roller at one side of the barrel, each roller at a 90° angle to its adjacent roller. Any combination of spin can be imparted to the ball by the simultaneous use of one or both rollers. The degree of spin is a function of the velocity of the ball and the speed at which the rollers are spun.

Balls returned to the machine are at a level about 8 feet beneath the exit barrel of the machine. Each ball passes first to an in-line magazine and thence sequentially to the inlet of the ball delivery. When the next signal to discharge a ball is received, a jet of 25 psi air moves the ball away from the net, around a curve and upward where a second jet of 25 psi air causes the ball to move into the upper barrel which points toward the player. Movement of the ball into the upper barrel trips a signal which causes the generation of a blast of air of the selected power to impart a selected velocity to the ball.

Appropriate computer programming can cause variations in the velocity, spin, and direction of balls released from the machine. Various programs can be inserted on computer cards which can be set into the machine. Each ball propelled from the machine causes the computer logic to go to the next step recorded on the card, so that the balls are released in predetermined sequence as to velocity, spin, direction, etc.

The court should be less than normal length and ⅔ normal width, approximately 70 feet long and 30 feet wide. The tennis net should be approximately 20 feet from the lower end of the slightly sloping court. The center portion should be crowned about 6 inches higher than the sides. Enclosure means such as a fence prevent mishit tennis balls from going too far. The backboard or wall at the end 20 feet from the net may have at least one slot through which the tennis ball machine hurls tennis balls. The plurality of tennis balls generally flow into the gutters which curve and converge to form a ball return conduit at the lowest point in the court. The backboard should be slanted so as to cause tennis balls hit thereto to fall downward. Multiple lines of different colors on the court simulate different playing experiences, such as service to the number 1 court, service to the number 2 court, or singles or doubles play.

The air-powered tennis ball machine comprises a generally vertical riser having one end coupled to the conduit means, a timer, an aimable barrel coupled to the end of the riser by flexible means, air jet means coupled to the conduit, the riser and barrel, barrel elevation means, barrel traverse means, vertical spin control means coupled to the interior of the barrel, horizontal spin control means coupled to the interior of the barrel, a ball machine control center coupled to each element of the machine, and power means.

The example described in the present patent further includes a ball delivery timing rotor, an elbow coupled at one end to the conduit and at its other end to the riser, a drive motor which drives the rotor, a riser jet solenoid valve switch triggered by the rotor which switch triggers the release of air from the air jet means, a main propellant valve trigger actuated by each tennis ball passing through the elbow coupled between the riser and flexible means, a main propellant valve microswitch actuated by the main propellant valve trigger, and a main propellant valve actuated by the main propellant valve microswitch which valve permits the release of air from the air jet means when actuated.

The example described herein further includes a polynoid which controls the elevation and traverse of the barrel, and trunion arms jointed by shoulder bolts coupled to the barrel which control the barrel through the barrel's vertical travel by means of movement generated by the polynoid. The vertical spin control means and the horizontal spin control means each comprise a solenoid capable of selected rotational velocities, direction of rotation and capable of insertion into the barrel a selected depth of penetration. A motor coupled to a motor mount, a bell crank and a wheel furnish solenoid power.

A barrel traverse polynoid coupled to a traverse joint and actuator which is coupled to the elbow coupled to the barrel rotates the elbow from left to right in relation to the riser, thereby causing the barrel to traverse from left to right. The traverse joint and actuator comprises a pair of torque arms hooked to a slip joint. A ball delivery light and air jet distribution manifold are also included.

DESCRIPTION OF THE DRAWINGS

Reference should be made at this time to the following detailed description which should be read in conjunction with the following drawings of which.

DETAILED DESCRIPTION

Figure 1:
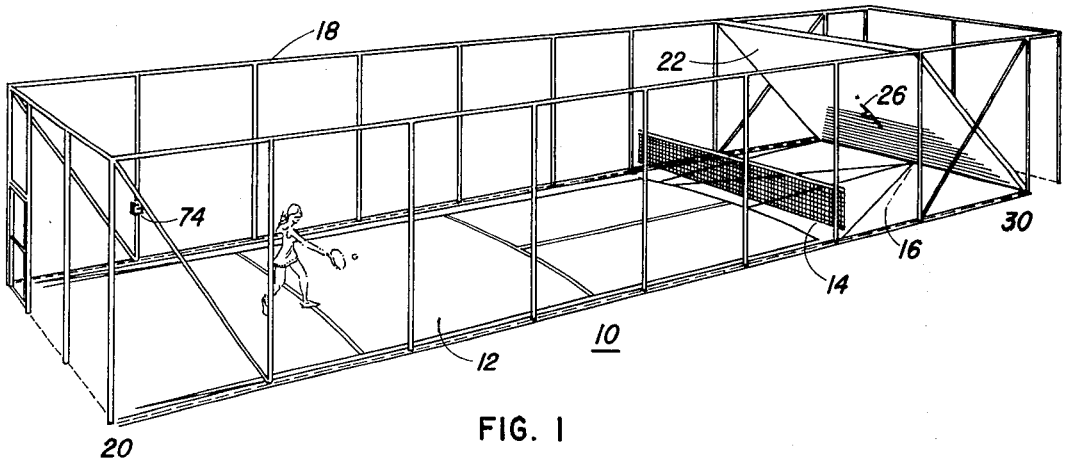
FIG. 1 is a perspective view of an instant tennis court, including a ball-hurling machine.
Figure 2:
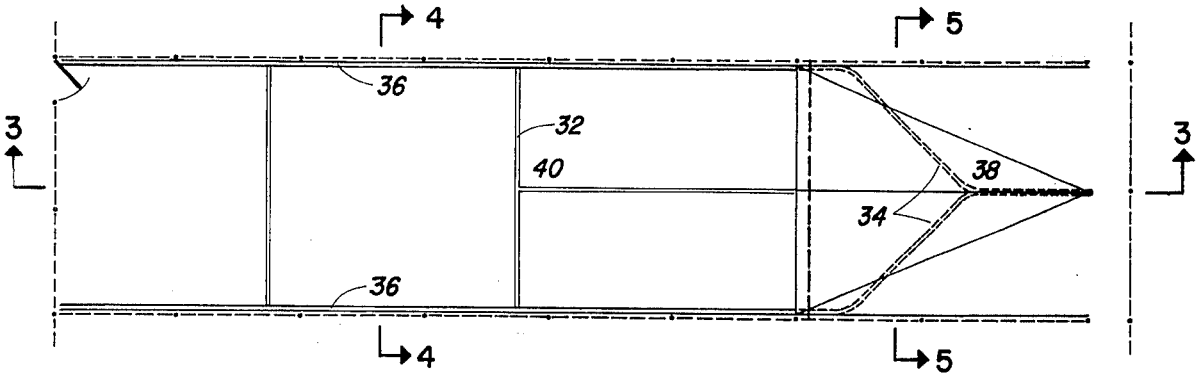
FIG. 2 is a plan view of the playing court and return surface illustrated in FIG. 1.
Figure 3:
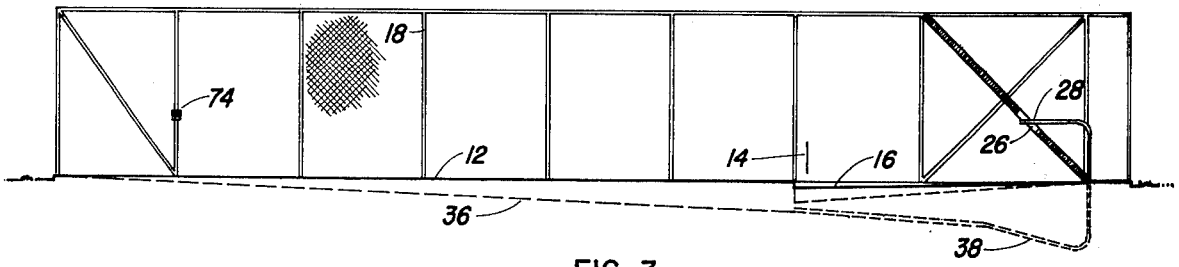
FIG. 3 is a vertical and longitudinal section of the invention of FIG. 2 along the line A—A.

Reference should be made at this time to FIGS. 1, 2, and 3 which illustrate perspective, plan view and longitudinal section drawings of an instant tennis game 10 according to the present invention. The game 10 comprises a partial court 12 less than ¾ normal length and about ½ normal width for a tennis court. The court 12 may be approximately 70 feet long and 30 feet wide. A tennis net 14 is disposed about 20 feet from one end 16 of the court 12. The game 10 is enclosed by a fence 18. The fence 18 should be of normal height near the net 14, but may be of less than normal height near the end 20 which is farthest from the net, since the purpose of the fence is to stop balls hit wildly. While the player may well hit the balls fairly high, it is very unlikely that the machine will hit balls toward the side 20 which will require a high fence. Since some players will hit balls at the most amazing angles from the point of contact, the fence 18 in FIG. 1 is illustrated as being of normal height all around the court 12.

A backboard 22 slanted so as to cause the tennis balls hit thereto to fall downward is placed near the end 16. The backboard 22 may be acoustically responsive and may simulate a background similar to that of a normal tennis court. This inclined backboard 22 or backstop 22 may allow a scoring mechanism to record and display the player's accuracy. This would be done by urging the player to hit for certain parts of the backstop 22 and keeping track of the number of times the player hits the selected segment (not illustrated) by means known to the prior art such as a pressure sensitive plate coupled electronically to an electronic counter and display.

A ball delivery machine 24, also referred to as a ball hurling machine 24, hurls ball through a slot 26 by barrel means 28.

In order to simulate service, the ball machine 24 may be moved to either side 30, 30 prime, of the backstop 22. While FIGS. 1 and 2 illustrate lines 32 similar to those found on a tennis court, for the simulation of service, the center line would have to be moved toward one side or another. It would, of course, be very easy to draw multiple lines 32, having different colors for the simulation of different playing experiences.

The surface 34 of the court 12 is crowned, and is higher along the center line 40, gradually sloping downward to side gutters 36. The side gutters 36 join near the short end of the court 16 to form a ball return conduit 38. The degree of crowning is such that tennis balls falling on the surface 34 roll to the nearest gutter 36.

Figure 4:
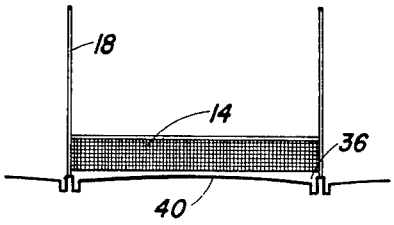
FIG. 4 is a transverse section of the invention of FIG. 2 along the line B—B.
Figure 5:
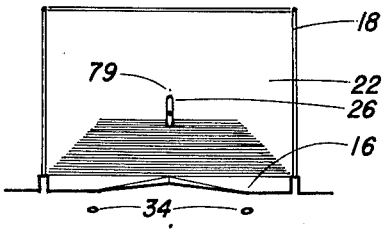
FIG. 5 is a transverse section of the invention of FIG. 2 along the line C—C.

Each gutter slopes downward from the end 20 toward the end 16 at an angle of about 3-¾%. Gravity causes the tennis balls to roll down the gutters 36 to the ball return conduit 38. When the balls reach the lowest point in the ball return conduit 38, air pressure means lifts them back to the ball machine 24 for return to the player. FIGS. 4 and 5 illustrate selected transverse sections of the court 12.

Figure 6:
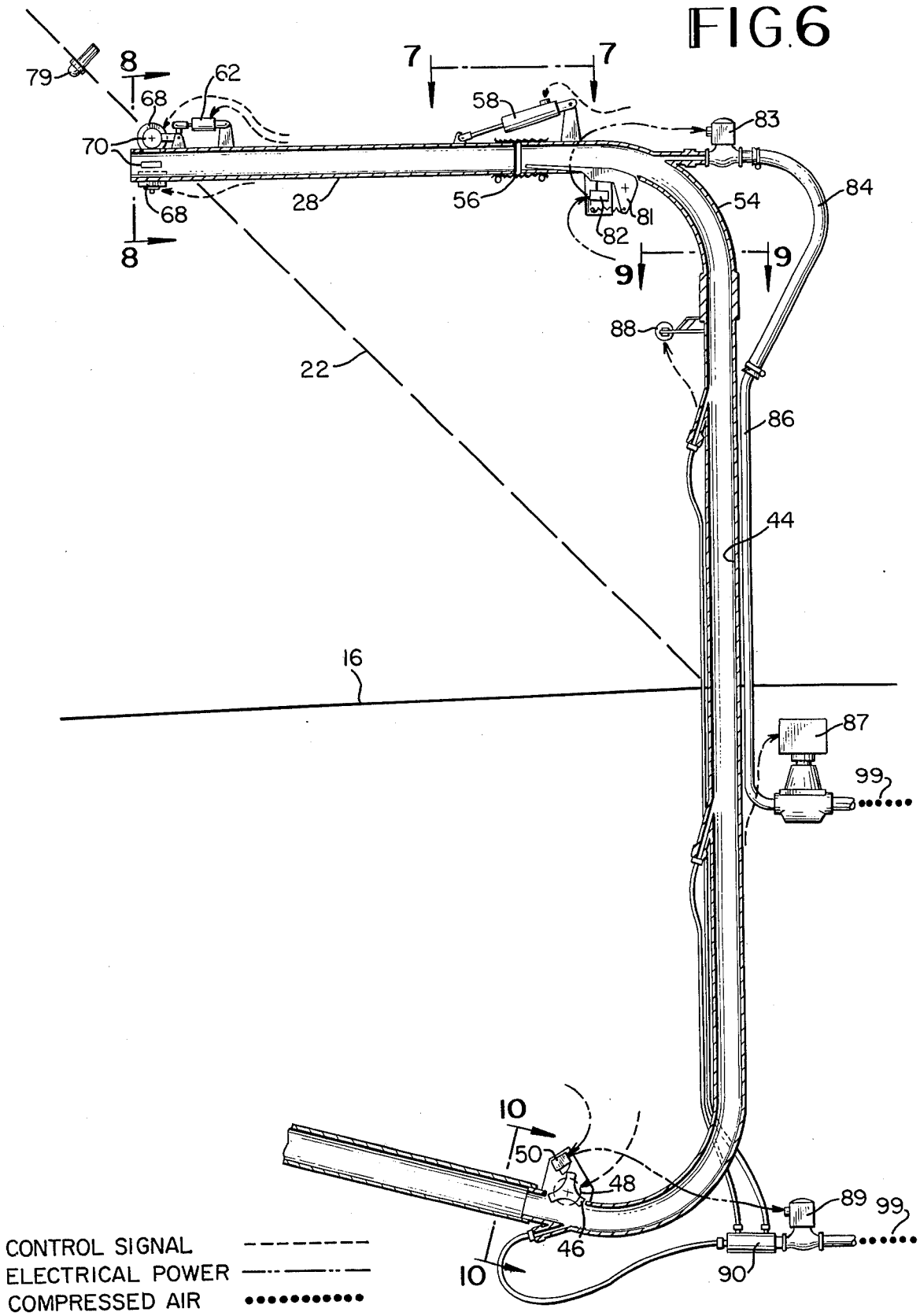
FIG. 6 is a vertical elevation of a ball hurling machine according to the present invention.

Reference should be made at this time to FIG. 6 which is a vertical section through the ball delivery machine 24. FIG. 6 may best be understood by viewing it in conjunction with FIG. 7, a plan detail of the ball delivery machine 24 barrel elevation joint, with FIG. 8 a vertical section detail of the ball spin control mechanism with FIG. 9 a horizontal section detail of the barrel traverse joint, and with FIG. 10 a vertical oblique section detail of the timing mechanism.

Tennis balls return via the gutters 36 to the conduit 38. The balls form a line behind a ball delivery timing rotor 46. The rotor 46 is set at a pre-determined rotation rate which determines the intervals between delivery of balls from the machine. The rotor 46 releases another tennis ball each one-third of a revolution. The rotor 46 continues to turn and picks up the next ball which is to be subsequently released. Momentum imparted by the rotor 46 and gravity cause the ball to roll to the elbow 76 joining the return conduit 38 to the riser 44. The velocity of the rotor is controlled by the timer 42. The rotor is powered by the drive motor 48. The rotor triggers the riser jets solenoid valve switch 50 subsequent to release of the ball. The switch 50 triggers the release of a blast of air of approximately 1.5 seconds in duration. The air is released through the air release hoses 99 beneath the rotor 46 and through the two additional air release hoses 99 which exit into the riser 44. The air pressure from the hoses 99 forces the ball to rise up the riser 44 around the top elbow 54 into the exit barrel 28 from the ball machine.

Figure 11:
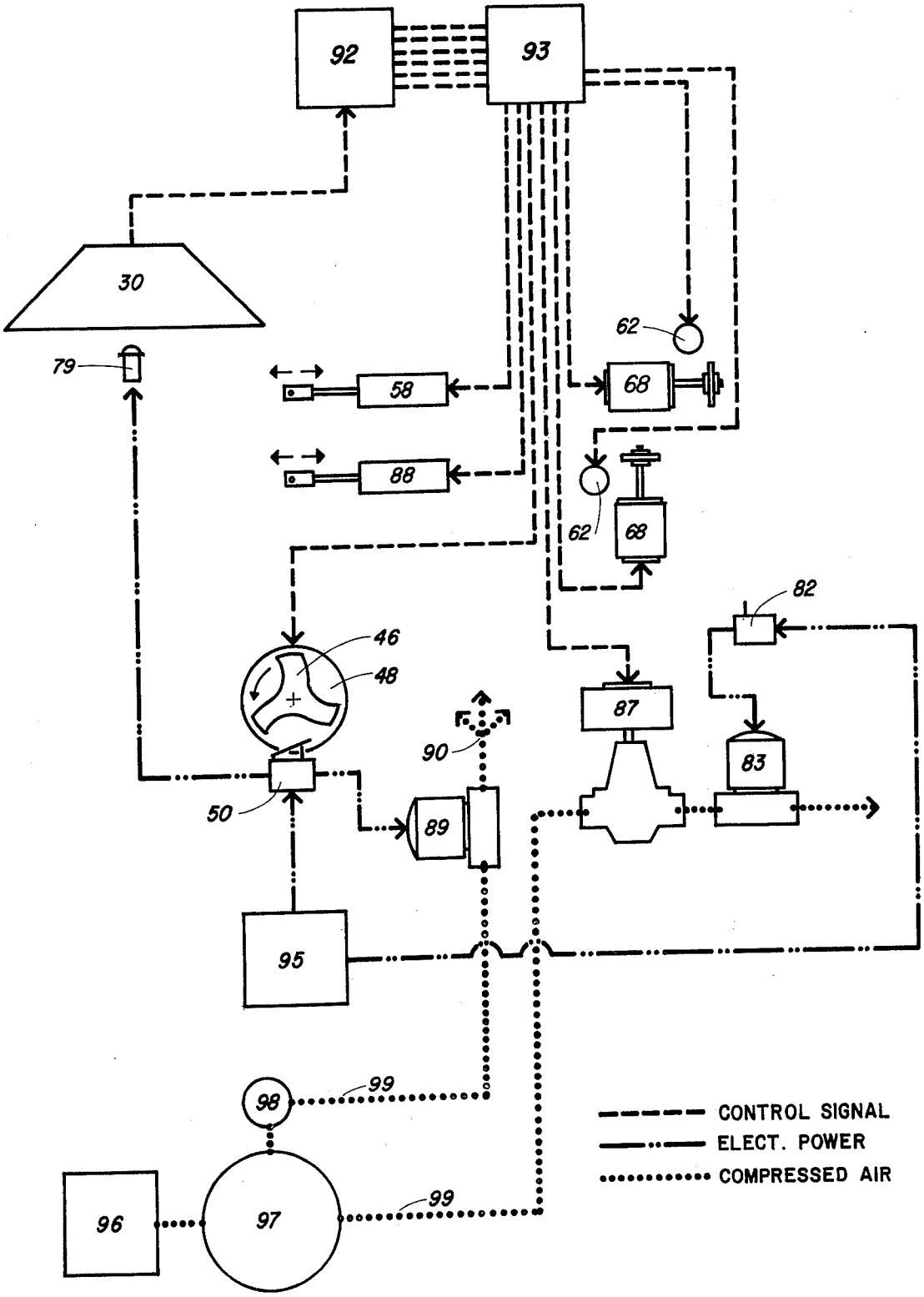
FIG. 11 is a single line circuit diagram for electrical power, control signals and compressed air for the ball hurling machine of FIG. 6.

Reference should be made at this time to FIG. 11, a single line circuit diagram for electrical power, control signals and compressed air. The ball trips a main propellant valve trigger 81 which throws a main propellant valve microswitch 82. The switch 82 causes a main propellant valve 83 to permit the release of a sufficient blast of air through main propellant air line 99 prime to accelerate the ball so that it goes to the pre-selected point on the court.

As the ball exits the barrel 28, it may be given a preselected spin to simulate any of the shots of tennis.

Figure 7:
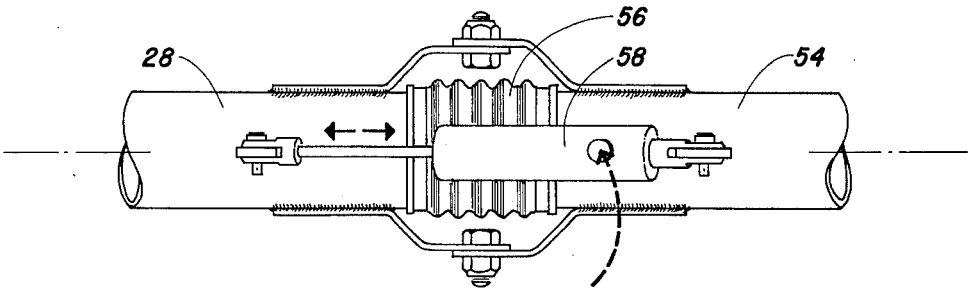
FIG. 7 is a plan detail drawing of the ball machine of FIG. 6 along the line 7—7, particularly illustrating the barrel elevation joint and polynoid actuator.

The elevation of the barrel 28 is controlled by a barrel elevation control 52 which is illustrated in detail in FIG. 7. A joint cover 56 couples the barrel 28 to the top elbow 54. A polynoid 58 controls the barrel according to instructions received from the user of the machine. Trunion arms jointed by shoulder bolts control the barrel through its vertical travel. The polynoid 58 is a linear motor which pushes or pulls the forward part of the barrel 28 up or down. Pre-determined elevations of the barrel 28 and ball velocity permit precise control over the landing point and the angle of travel of the ball.

Figure 8:
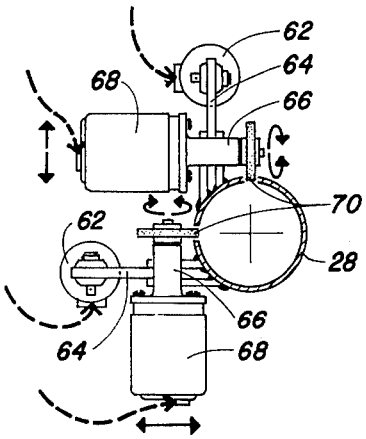
FIG. 8 is a vertical section detail drawing of the ball hurling machine of FIG. 6 along the line 8—8 particularly illustrating the ball spin control mechanism.

The spin control mechanism 60 is best illustrated in FIG. 8. Two spin control solenoids 62 are capable of generating spin in both directions. The depth of penetration of the solenoids 62 into the barrel 28 and the rotational velocity of spinning both control the amount of spin put on the ball. Various combinations of spin from two perpendicular axes permit simulation of all possible types of spin which a tennis player can impart, whether the tennis player is left-handed or right-handed. A wheel 70 is spun by a motor 68 coupled to a motor mount 66 and a bell crank 64. Small DC motors which have very nearly instant start up capability are utilized to provide the power for spinning the balls.

Figure 9:
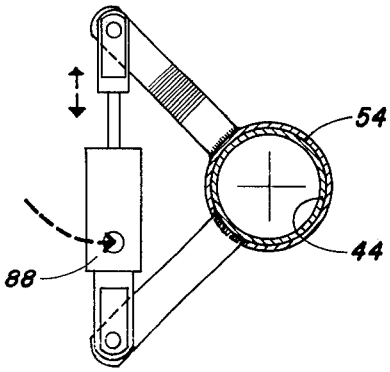
FIG. 9 is a horizontal section detail drawing of the ball hurling machine of FIG. 6 along the line 9—9 particularly illustrating the machine barrel traverse joint and polynoid actuator.

FIG. 9 illustrates a traverse joint and actuator 72 which traverses the barrel from left to right in order to determine whether the ball is to be propelled at the player or to the player's backhand or forehand. The traverse joint 72 rotates the upper elbow 54 in relation to the fixed position riser 44. Power for the rotation is supplied by a barrel traverse polynoid 88. The traverse joint and actuator comprises a pair of torque arms hooked to a very simple slip joint. A linear motor pushes or pulls and thereby causes the barrel to go to either right or left.

Figure 10:
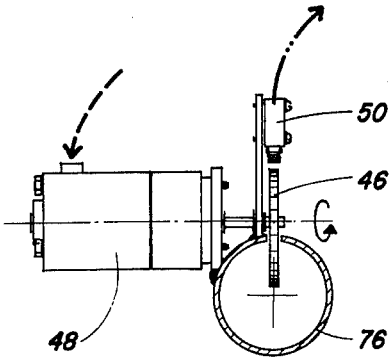
FIG. 10 is a vertical-oblique section detail drawing of the ball hurling machine of FIG. 6 particularly illustrating the machine's timing mechanism.

The timing mechanism 42 is best illustrated in FIG. 10. The motor 48 is a single direction rotation 110 volt instrument gear head motor or the equivalent. For most purposes, the motor turns the rotor at 4 or 5 RPM at the output shaft. There are three lobes on the rotor 46 so that three balls are released at equal intervals during every rotation of the motor. At 5 RPM rotational speed, 15 balls per minute would be released from the machine. The rotor 46 acts as a cam as it turns. As each lobe comes around past the microswitch 50, it activates the microswitch 50 to trigger the blast of air moving the ball into position for delivery by a second blast of air.

As best illustrated in FIG. 11, an air compressor 96 keeps a compressed air reservoir tank 97 filled to standards which are set by a pressure regulator 98. The pressure regulator 98 may be manually controlled. Air from the compressed air reservoir tank 97 flows to air lines 99 from which the air is dispensed to propel the ball. A low voltage DC transformer 95 or the equivalent such as a 110 VAC source provides power for the machine 24.

A control panel and scoring read-out 92 provides two functions. It permits the player to set in a request for serve, spin, velocity, interval, direction, etc. In addition, it indicates how well the player is doing with his or her returns. Various cards can be inserted into the control panel 92 to cause the machine 24 to deliver a pre-selected series of shots. In the alternative, a mini computer 93 can generate random numbers or can generate shots according to a program which can be set in by card, disc, tape, or other well-known means. A ball delivery light 79 can be set to warn the player a pre-selected period of time before each shot. A riser jet distribution manifold routes air to the selected line 99, 99 prime, from the air tank 97.

A particular example of the invention has been described herein. Other examples within the scope of the present invention will be obvious to those skilled in the art. The present invention is limited only by the following claims.

What is claimed is:

1. A tennis game practice device comprising the combination of a simulated tennis court approximately 70 feet long and 30 feet wide and an air-powered tennis ball projecting machine for projecting tennis balls onto said tennis court;

a tennis net positioned transversely of said court and placed approximately 20 feet from one end of said tennis court;

crowning of said court along its longitudinal axis such that its center portion is approximately 6 inches higher than its sides;

gutters adjacent each side of said tennis court which gutters slope downward towards said one end 20 feet from said net at a grade of approximately 3¾ percent, said gutters curving near said one end 20 feet from said net so that they come together to form a generally horizontal ball return conduit at a lowermost point of said court;

enclosure means for preventing substantially all tennis balls hit by a player from leaving the court;

a wall at said end 20 feet from said net having a slot therethrough and an image of target areas impressed thereon, said target areas simulating various points on a conventional tennis court;

said tennis ball projecting machine having an aimable barrel extending through said slot in said wall for projecting tennis balls through said slot to selected areas of said tennis court;

said barrel having means attached thereto for selectively imparting and varying spin and speed to a projected ball;

a generally vertical riser having one of its ends coupled to said generally horizontal conduit;

said aimable barrel being coupled to the other end of said riser by flexible means;

air jet means coupled to said conduit, said riser and said barrel for projecting tennis balls therethrough;

said tennis ball projecting machine being provided with timing means whereby operations of said machine are timed for automatically delivering balls to a player at selected time intervals;

barrel elevating means for vertically adjusting said barrel;

barrel traverse means for adjusting the horizontal direction in which balls are projected;

said means coupled to said barrel for imparting vertical and horizontal spin to a projected ball;

a ball projecting machine control center coupled to said machine;

power means for transmitting power to said tennis ball projecting machine;

a motor driven ball delivery timing rotor connected to the ball projecting machine for delivering balls from said conduit to said barrel at a pre-determined rate of delivery;

an elbow having one of its ends coupled to said conduit and having its other end coupled to one end of said riser;

a riser air jet solenoid valve switch triggered by said rotor for releasing air from said jet means coupled to said conduit for propelling balls from said conduit through said elbow and into said riser; and an elbow coupled between said riser and said barrel, one end of said barrel being coupled to one end of said elbow by said flexible means and the other end of said elbow being rotatably coupled to the other end of said riser.

2. The invention of claim 1 further including a main propellant valve trigger connected to said barrel and actuated by each tennis ball passing through said elbow coupled between said riser and flexible means;

a main propellant valve microswitch actuated by said main propellant valve trigger; and a main propellant valve actuated by the main propellant valve microswitch for permitting the release of air from said air jet means to propel a ball through said barrel.

3. The invention of claim 1 wherein said barrel elevation means and barrel traverse means are Polynoids; a Polynoid being connected to said machine for movement of said barrel in substantially vertical and horizontal planes; and wherein said ball spin means are a pair of motor driven rotating elements, said rotating elements being mounted adjacent the exit end of said barrel and extending through a pair of slots in said barrel for engagement with balls passing through said exit end, one of said rotating elements being adjustable in one of said slots in the vertical plane of said barrel and the other of said rotating elements being adjustable in the other of said slots in the horizontal plane of said barrel, each rotating element being independently adjustable to various depths of penetration into said barrel to thereby impart various combinations of spin to a ball passing through said barrel.

4. The invention of claim 1 including barrel elevation and traverse Polynoids, and means for actuating said Polynoids to move said barrel relative to said riser to direct projected balls to various points on said court.

5. The invention of claim 4 wherein a ball delivery light is coupled to the control center said light being means to warn a player a preselected period of time before each ball is projected by said machine;

and an air jet distribution manifold coupled to the control center, the conduit, the riser and the barrel.

* * * * *